US010285455B2

(12) United States Patent
Hooks

(10) Patent No.: US 10,285,455 B2
(45) Date of Patent: May 14, 2019

(54) BRA CLIP

(71) Applicant: Khori Hooks, Philadelphia, PA (US)

(72) Inventor: Khori Hooks, Philadelphia, PA (US)

(73) Assignee: Khori Hooks, Philadelphia, PA (US)

( * ) Notice: Subject to any disclaimer, the term of this patent is extended or adjusted under 35 U.S.C. 154(b) by 0 days.

(21) Appl. No.: 15/649,864

(22) Filed: Jul. 14, 2017

(65) Prior Publication Data

US 2019/0014830 A1 Jan. 17, 2019

(51) Int. Cl.
*A41C 3/12* (2006.01)
*A41D 27/12* (2006.01)

(52) U.S. Cl.
CPC ..... *A41C 3/126* (2013.01); *A41D 27/12* (2013.01)

(58) Field of Classification Search
CPC ..... A41C 3/1126; A41C 3/12; A41C 3/122
USPC ..... 450/41, 48; 2/257
See application file for complete search history.

(56) References Cited

U.S. PATENT DOCUMENTS

| | | | | |
|---|---|---|---|---|
| 5,749,767 | A | 5/1998 | Arceo | |
| 6,152,802 | A * | 11/2000 | Horta | A41C 3/126 450/48 |
| 6,186,862 | B1 * | 2/2001 | Fildan | A41C 3/122 450/41 |
| 7,189,138 | B1 * | 3/2007 | Utaka | A41C 3/126 450/41 |
| 7,850,507 | B2 * | 12/2010 | Horta | A41C 3/126 450/41 |
| 8,778,475 | B2 | 7/2014 | Joyce et al. | |
| 9,693,951 | B2 * | 7/2017 | Potter | A61K 9/0021 |
| 2010/0242157 | A1 * | 9/2010 | Littell | A41C 3/12 2/257 |

* cited by examiner

*Primary Examiner* — Gloria M Hale
(74) *Attorney, Agent, or Firm* — McCarter & English, LLP

(57) ABSTRACT

An example bra clip is described. The bra clip includes a body defining a proximal end and a distal end, a first body half extending between the proximal and distal ends, and a second body half extending between the proximal and distal ends. The first and second body halves define an enclosure therebetween. The bra clip includes first and second side openings extending between and separating the first body half from the second body half. The bra clip includes an opening at the distal end of the body. The opening extends into the enclosure between the first and second body halves.

19 Claims, 15 Drawing Sheets

BRA CLIP

BACKGROUND

Bras generally include underwire extending along the bottom perimeter of each cup to provide the necessary structure and support. The underwire is generally sewn into the material or seam at the bottom perimeter of the cup. Over time, one or both ends of the underwire can wear through the adjacent material, resulting in the end(s) of the underwire extending from the bra. Such extension of the underwire can create discomfort to the wearer and generally requires discarding of the bra.

SUMMARY

Exemplary embodiments of the present disclosure provide bra clips configured to be positioned over the endpoint of the underwire of the bra to prevent initial extension of the underwire through the material of the bra and/or to reduce discomfort from the extending underwire endpoint. In one embodiment, the exemplary bra clips can be positioned over the extending underwire and over the material of the bra, thereby attaching the bra clips to the outer surfaces of the bra. Such bra clips can include an engagement mechanism in the form of oppositely disposed teeth or textured surfaces that maintain the position of the bra clip on the bra. The external bra clips can be detached from the bra and repositioned, or used with another bra, as needed without losing their advantageous functionality. In another embodiment, the exemplary bra clips can be positioned over the underwire and sewn directly into the material of the bra, thereby attaching the bra clips within the bra material. The exemplary bra clips can therefore be used to extend the overall life of the bra by protecting the user from the exposed underwire or by preventing the underwire from passing through the material of the bra in the first place.

In accordance with embodiments of the present disclosure, an exemplary bra clip is provided. The bra clip includes a body defining a proximal end and a distal end. The body includes a first body half extending between the proximal and distal ends, and a second body half extending between the proximal and distal ends. The first and second body halves can define an enclosure therebetween configured to receive at least an endpoint of the underwire of the bra. The bra clip includes first and second side openings extending between and separating the first body half from the second body half. The bra clip includes an opening at the distal end of the body. The opening can extend into the enclosure between the first and second body halves.

The bra clip can include a closed end at the proximal end of the body. In some embodiments, the closed end can include a dome-shaped or curved top or partially curved top of the bra clip. In some embodiments, the first and second side openings can each include a substantially rounded end or edge near the closed end of the proximal end of the body. The rounded end or edge can serve as a hinge-point for flexing the first and second body halves away from each other when inserting the bra clip over the bra material. Such flexibility allows the bra clip to fit over bras of different sizes, and the first and second halves can spring back towards each other to assist in maintaining the position of the bra clip on the bra.

In some embodiments, each of the first and second side openings can be tapered from the proximal end to the distal end of the body, with the proximal end of the first and second side openings being dimensioned greater than the distal end of the first and second side openings. In some embodiments, the first and second body halves can be disposed adjacent to each other and can be flexed away from each other to create the opening therebetween.

The first and second body halves can each include an engagement mechanism to assist in retaining the position of the bra clip over the bra. The engagement mechanism can be disposed at or near the distal end of the first and second body halves. In some embodiments, the engagement mechanism of the first body half can include a first cutout and a first protrusion on opposing sides of the first body half, and the engagement mechanism of the second body half can include a second protrusion complementary to the first cutout and a second cutout complementary to the first protrusion.

In some embodiment, the engagement mechanism of the first body half can include a single cutout and the engagement mechanism of the second body half can include a single protrusion complementary in respect to shape to the cutout. The spring-type force of the first and second body halves towards each other pushes the protrusion(s) into the material of the bra, and further pushes the material of the bra into the cutout, thereby engaging the bra clip with the bra material. In some embodiments, the engagement mechanism can be in the form of a textured or rough surface to create a friction engagement with the bra material.

The first and second body halves can define an inner diameter of the enclosure. In some embodiments, the inner diameter can be substantially uniform between the proximal and distal ends of the body. In such embodiments, the first and second body halves together can define a substantially cylindrical configuration. In some embodiments, an inner curvature of the first and second body halves can incrementally increase from the proximal end to the distal end of the body.

In some embodiments, the bra clip can include a soft material disposed on one or more outer surfaces of the body (e.g., any material having a softer feel than the base material of the bra clip). Such soft material can provide additional comfort to the user when the user's skin is in contact with the bra clip. As will be discussed in greater detail below, the first and second body halves can be configured to be positioned on opposing sides of a bra with the bra extending into the first and second side openings and the enclosure fitting over a seam containing an underwire of the bra, thereby preventing the exposed underwire from contacting the user.

In accordance with embodiments of the present disclosure, an exemplary bra clip is provided. The bra clip includes a body defining a proximal end and a distal end. The body includes a closed end at the proximal end and an opening at the distal end. The opening can extend into an enclosure within the body. The bra clip includes a first flange extending from one side edge of the body, and a second flange extending from an opposing side edge of the body. The enclosure can be configured to receive therein an endpoint of an underwire of a bra. The first and second flanges can be configured to be secured to material of the bra surrounding the underwire to maintain a position of the underwire.

In some embodiments, one or a plurality of portions of the first and/or second body comprise a fabric layer that adheres to the first and/or second body. The optional fabric piece may be made of any fiber or fabric, including satin, lace, wool, polyester, microfiber, cotton, denim, silk, or blend of any plurality of the fabric or any synthetic blend of microfibers.

In some embodiments, the first and second flanges can extend substantially perpendicularly or perpendicularly relative to the respective side edges of the body. In some embodiments, the first and second flanges can extend substantially parallel to each other. In some embodiments, the first and second flanges can define a thickness smaller than a thickness of walls of the body. In some embodiments, the first and second flanges can be fabricated from a softer material than the body of the bra clip. The first and second flanges can be configured to be sewn through to secure the first and second flanges to the material of the bra surrounding the underwire, thereby securing the bra clip within the material of the bra to prevent the underwire from extending through the bra material. In some embodiments, the body of the bra clip can include flat side walls connected by chamfered corners, the first and second flanges extending from two of the flat side walls.

In accordance with embodiments of the present disclosure, an exemplary bra is provided. The bra includes an underwire including first and second opposing ends, and a bra clip disposed at least on one of the first and second opposing ends of the underwire. The bra clip can include a body defining a proximal end and a distal end. The body includes a closed end at the proximal end and an opening at the distal end. The opening extends into an enclosure within the body. The bra clip can include a first flange extending from one side edge of the body, and a second flange extending from an opposing side edge of the body. The enclosure can receive therein the first or second end of the underwire of the bra. The first and second flanges can be secured to the material of the bra surrounding the underwire to maintain a position of the bra clip around the endpoint of the underwire.

Any combination and/or permutation of embodiments is envisioned. With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed bra clips, reference is made to the accompanying figures, wherein.

DETAILED DESCRIPTION

Figure 1:
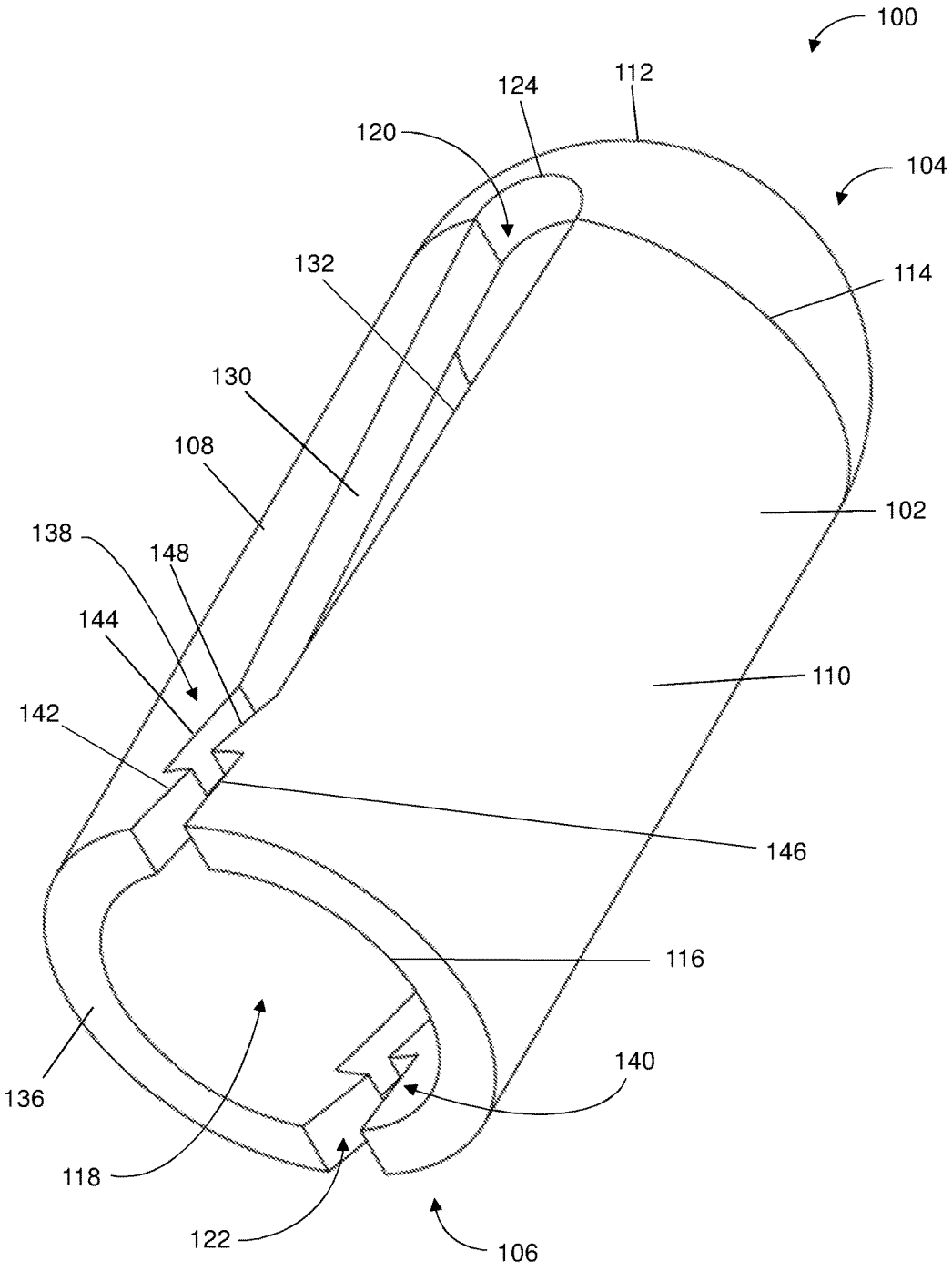
FIG. 1 is a diagrammatic, perspective view of an exemplary bra clip of the present disclosure.
Figure 2:
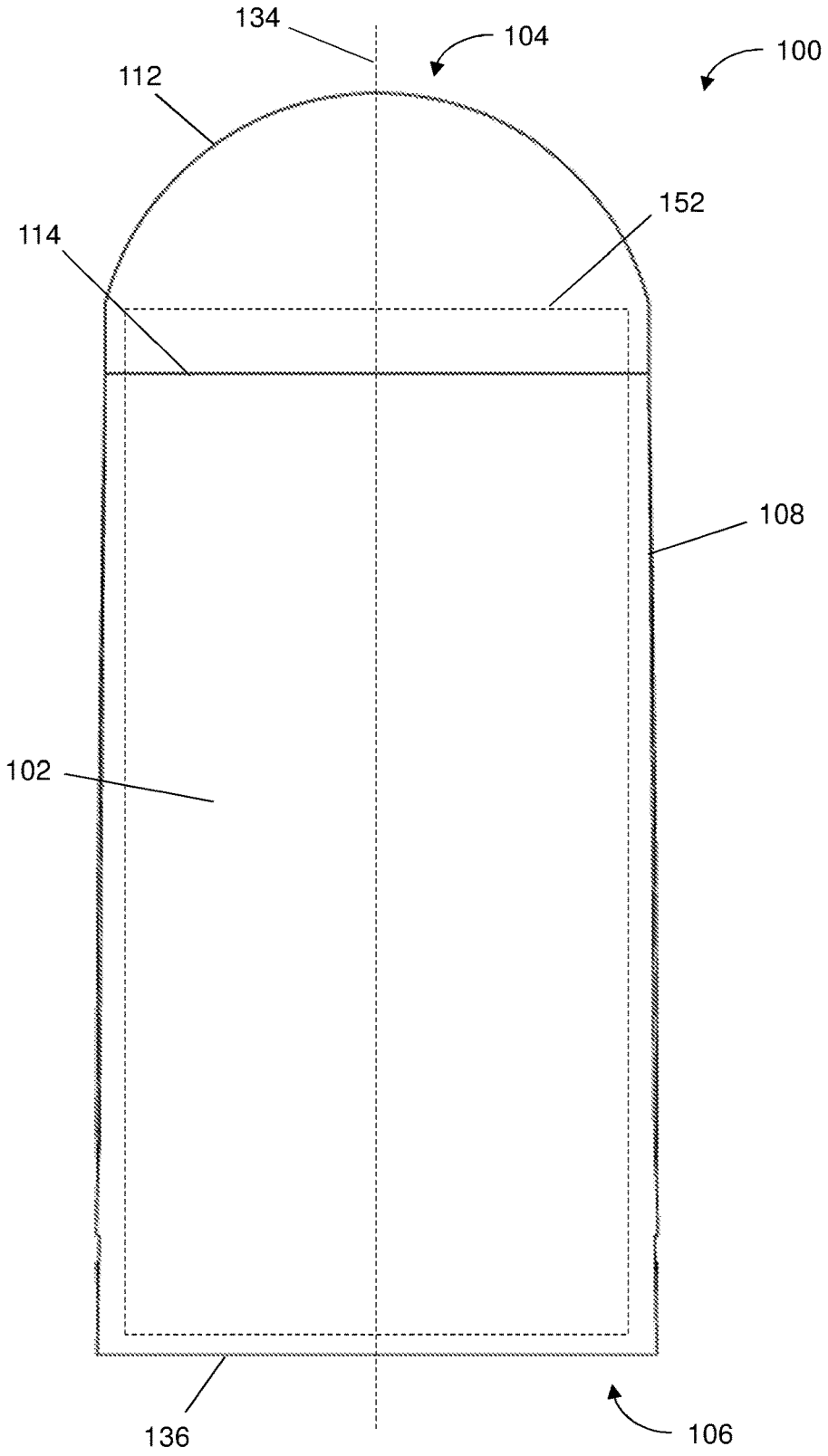
FIG. 2 is a diagrammatic, front view of an exemplary bra clip of FIG. 1.

FIGS. 1-4 are diagrammatic, perspective, front, side and bottom views of an exemplary bra clip 100 of the present disclosure. The bra clip 100 can be positioned over the outer surface of a bra to prevent discomfort caused by a protruding underwire. In some embodiments, the bra clip 100 can be fabricated from a plastic material, rubber material, or a metal material (e.g., niobium metal). The bra clip 100 includes a body 102 with proximal and distal ends 104, 106 on opposing sides of the body 102. The body 102 includes first and second body halves 108, 110 extending substantially between the proximal and distal ends 104, 106. In particular, the bra clip 100 includes a closed end 112 at the proximal end 104 of the body 102. The bottom or distal end of the closed end can define a circumferential connecting section 114 from which the first and second body halves 108, 110 extend. In some embodiments, the closed end 112 can define a substantially dome-shaped or convex-shaped top of the bra clip 100. The smooth curvature of the closed end 112 can prevent clothing of the user from catching on the bra clip 100 during use.

Figure 4:
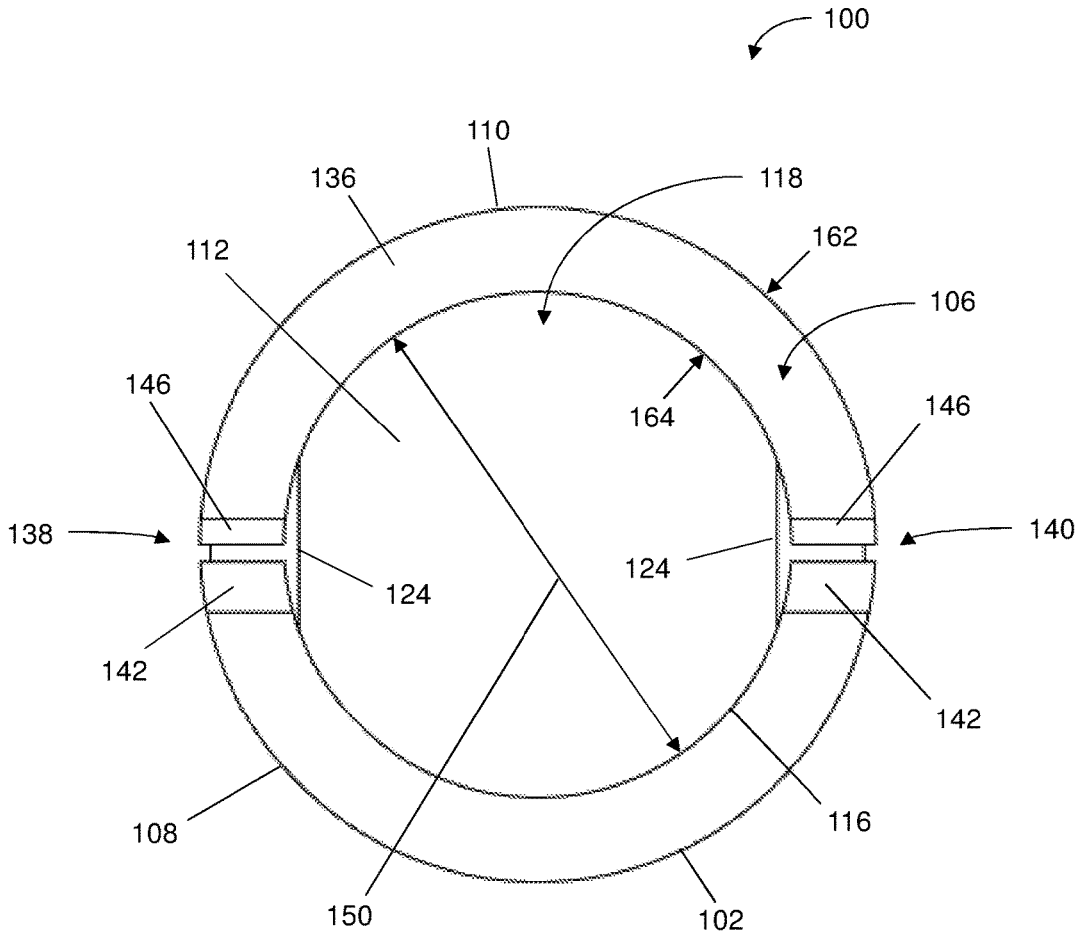
FIG. 4 is a diagrammatic, bottom view of an exemplary bra clip of FIG. 1.

The distal end 106 of the bra clip 100 includes an opening 116 extending into an enclosure 118 formed between the first and second body halves 108, 110. In some embodiments, the first and second body halves 108, 110 can each define a substantially semi-circular curvature, thereby forming a substantially cylindrical configuration. For example, as shown in FIG. 4, the inner diameter 150 of the enclosure 118 can be substantially uniform between the proximal and distal ends 104, 106. Although shown as substantially cylindrical, in some embodiments, the overall configuration of the first and second body halves 108, 110 can be flatter (e.g., non-cylindrical, oval, or the like). The enclosure 118 can be configured and dimensioned to accommodate a portion of the bra material such that the bra clip 100 can be positioned over an edge of the bra and over a protruding underwire endpoint.

Figure 3:
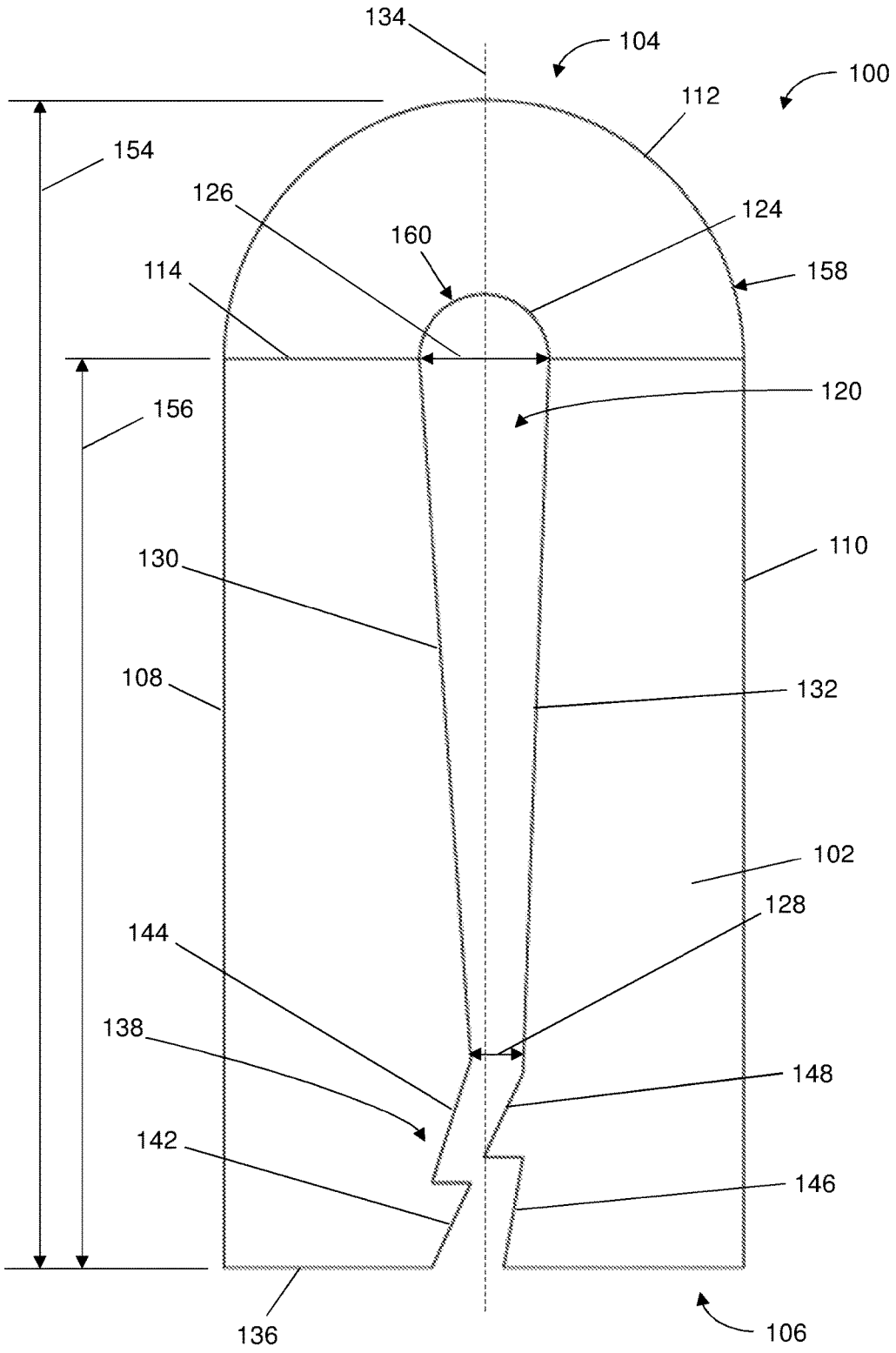
FIG. 3 is a diagrammatic, side view of an exemplary bra clip of FIG. 1.

The bra clip 100 includes first and second side openings 120, 122 extending between and separating the first and second body halves 108, 110. The side openings 120, 122 can extend from the distal end 106 to a point at the closed end 112 beyond the connecting section 114. In particular, each side opening 120, 122 can include a rounded end or edge 124 near the closed end 112. For example, as shown in FIG. 3, the rounded end or edge 124 can extend above the connecting section 114 and extends through the closed end 112, while the remaining portion of the side openings 120, 122 extends from the connecting section 114 to the distal end 106. The rounded end or edge 124 can act as a hinge for flexing the first and second body halves 108, 110 away from each other during positioning of the bra clip 100 over the bra material.

In some embodiments, as shown in FIG. 3, the side openings 120, 122 can be tapered from the proximal end 104 to the distal end 106 such that the diameter or distance 126 between the first and second body halves 108, 110 at or near the proximal end 104 is dimensioned greater than the distance 128 between the first and second body halves 108, 110 at or near the distal end 106. The first and second body halves 108, 110 include side surfaces 130, 132 that face each other. In some embodiments, the side surfaces 130, 132 can be substantially flat. In some embodiments, as shown in FIG. 3, the side surfaces 130, 132 can be angled relative to a central longitudinal axis 134, thereby defining the tapered shape of the side openings 120, 122. In some embodiments, the angle of the side surfaces 130, 132 relative to the central longitudinal axis 134 can be substantially the same.

In some embodiments, the angle of the side surfaces 130, 132 relative to the central longitudinal axis 134 can be different. For example, as shown in FIG. 3, the side surface 130 can taper at a greater angle than the side surface 132 relative to the central longitudinal axis 134. In such embodiments, the bra clip 100 can define an asymmetrical configuration along the central longitudinal axis 134 when viewed from the side (see, e.g., FIG. 3), while defining a symmetrical configuration along the central longitudinal axis 134 when viewed from front (see, e.g., FIG. 2). In some embodiments, the side surfaces 130, 132 can be substantially parallel to the central longitudinal axis 134, thereby defining a substantially uniform distance 126, 128 between the proximal and distal ends of the side openings 120, 122. In such embodiments, the bra clip 100 can define an asymmetrical configuration along the central longitudinal axis 134 from both the side and front views. In some embodiments, the side surface 132 can be substantially parallel to the central longitudinal axis 134, while the side surface 130 is angled relative to the central longitudinal axis 134.

In some embodiments, the distal end 106 of the bra clip 100 can define a substantially flat end surface 136. In some embodiments, the edge at the end surface 136 can be chamfered. In some embodiments, the overall height or length 154 of the bra clip 100 can be approximately 1.1 inches, and the height or length 156 between the end surface 136 and the connecting section 114 can be approximately 0.7 inches. In some embodiments, the radius 158 of curvature of the closed end 112 can be approximately 0.2 inches, and the radius 160 of curvature of the edge 124 can be approximately 0.05 inches. In some embodiments, the radius 162 of curvature of the outer bottommost edge of the bra clip 100 can be approximately 0.2 inches, and the radius 164 of curvature of the inner bottommost edge of the bra clip 100 can be approximately 0.15 inches.

One or both of the first and second body halves 108, 110 can include an engagement mechanism or feature 138, 140. The engagement feature 138, 140 can assist in maintaining the position of the bra clip 100 on the bra material by engaging the bra material. For example, the engagement feature 138, 140 in the first body half 108 can be in the form of a tooth or protrusion 142 extending from the distal end 106 of the side surface 130, and a cutout 144 inwardly directly in the side surface 130 adjacent (above) the protrusion 142. The engagement feature 138, 140 in the second body half 110 can be in the form of a complementary cutout 146 inwardly directed in the side surface 132 near the distal end 106, and a complementary tooth or protrusion 148 extending adjacent (above) the cutout 144.

Although shown as having both a cutout and a protrusion, in some embodiments, the side surface 130 can include only the cutout 144 and the side surface 132 can include only the protrusion 148 (or vice versa). When positioned over the bra material, the protrusions 142, 148 can push the bra material into the respective cutouts 144, 146, thereby engaging the bra material and preventing undesired movement of the bra clip 100. In some embodiments, rather than cutouts and protrusions, the engagement mechanisms 138, 140 can be in the form of rough or textured surfaces that create a friction fit over the bra material.

In some embodiments, one or more outer surfaces of the bra clip 100 (e.g., the outer surface of the first body half 108, the outer surface of the second body half 110, the outer surface of the closed end 112, combinations thereof, or the like) can include a material 152 thereon to provide comfort the user when implementing the bra clip 100. For example, the material 152 can be secured or glued to the outer surfaces of the bra clip 100 that generally contact the skin of the user. The material 152 can be softer and/or smoother than the underlying material of the body 102 to provide greater comfort to the user. In some embodiments, the material 152 can be, e.g., cotton, moleskin, silk, combinations thereof, or the like.

Figure 5:
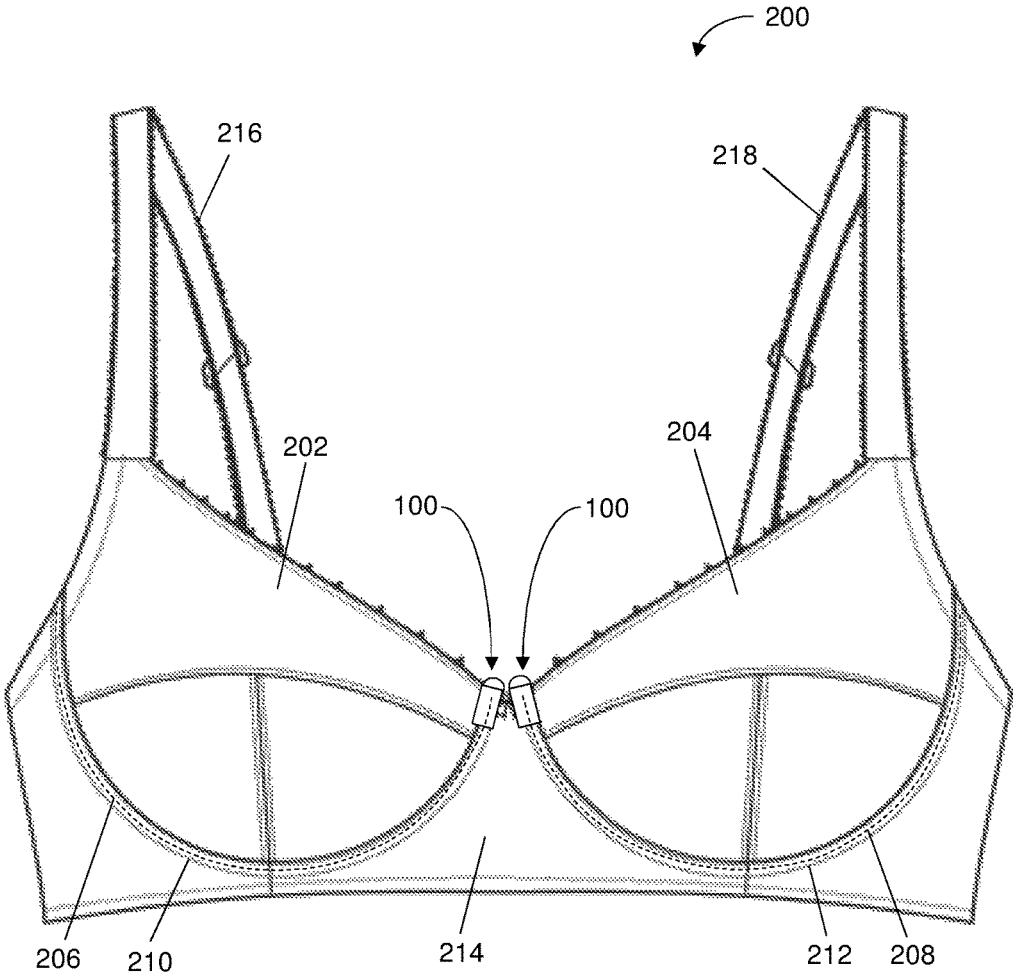
FIG. 5 is a diagrammatic, front view of a bra with two exemplary bra clips of FIG. 1 attached over underwire of the bra.
Figure 6:
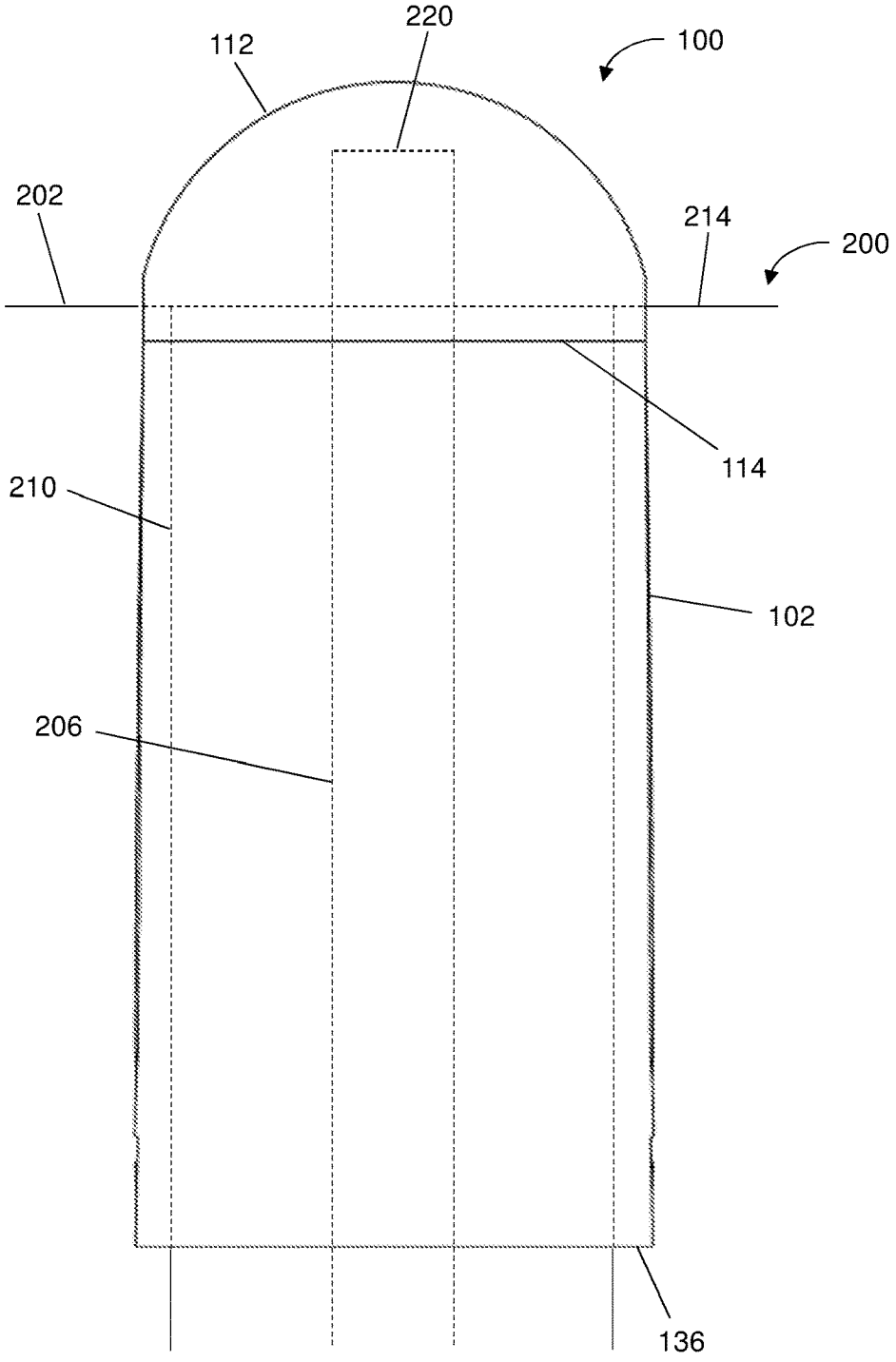
FIG. 6 is a diagrammatic, detailed front view of a bra with an exemplary bra clip of FIG. 1 attached over underwire of the bra.

FIGS. 5 and 6 are diagrammatic front and detailed views of a bra 200 with two exemplary bra clips 100 attached to the outside of the bra 200. Generally, the bra 200 includes two cups 202, 204, each cup 202, 204 including an underwire 206, 208 for providing support and shape to the cup 202, 204. The underwire 206, 208 is generally inserted between the bra material, the material being sewn around the underwire 206, 208 to form a seam 210, 212. The underwire 206, 208 is therefore initially enclosed within the seam 210, 212. The bra 200 can include additional material 214 between and/or around the cups 202, 204, and can include straps 216, 218.

Over time, the endpoints 220 of the underwire 206, 208 can tear through the material of the seam 210, 212 to protrude from the seam 210, 212, thereby contact the user wearing the bra 200 and causing discomfort. As shown in FIG. 6, the exemplary bra clip 100 can be positioned over the seam 210 to prevent further extension of the underwire 206 and to prevent contact between the underwire 206 and the user's skin. In particular, the material 214 and/or seam 210 can be passed through the side openings 120, 122 of the bra clip 100 such that the first and second body halves 108, 110 are disposed on opposing sides of the bra 200 (e.g., the inner and outer sides of the bra 200).

In some embodiments, the first and second body halves 108, 110 can be flexed away from each other to accommodate the thickness of the bra 200. The bra clip 100 can be oriented such that the endpoint 220 of the underwire 206 is enclosed by the closed end 112, and the upper edge of the bra 200 is positioned against or near the rounded edge 124 of the side openings 120, 122. The rounded or curved configuration of the first and second body halves 108, 110 accommodates the potentially thicker or greater amount of material at the seam 210, while ensuring that the endpoint 220 of the underwire 206 is fully enclosed by the bra clip 100. The rounded or curved configuration of the first and second body halves 108, 110 positioned over the seam 210 also assists in maintaining the position of the bra clip 100.

Upon release of the first and second body halves 108, 110 after positioning of the bra clip 100 on the bra 200, the engagement mechanisms 138, 140 engage the material 214 to prevent undesired removal or movement of the bra clip 100 from the bra 200. The bra clip 100 can therefore be used to prevent discomfort to the user from a protruding underwire 206, 208, or can be used as a preventative measure before the underwire 206, 208 tears through the seam 210, 212. The bra clip 100 can be easily attached or detached from the bra 200 for repositioning, and can be reused with different bras 200 without losing its advantageous functionality.

Figure 7:
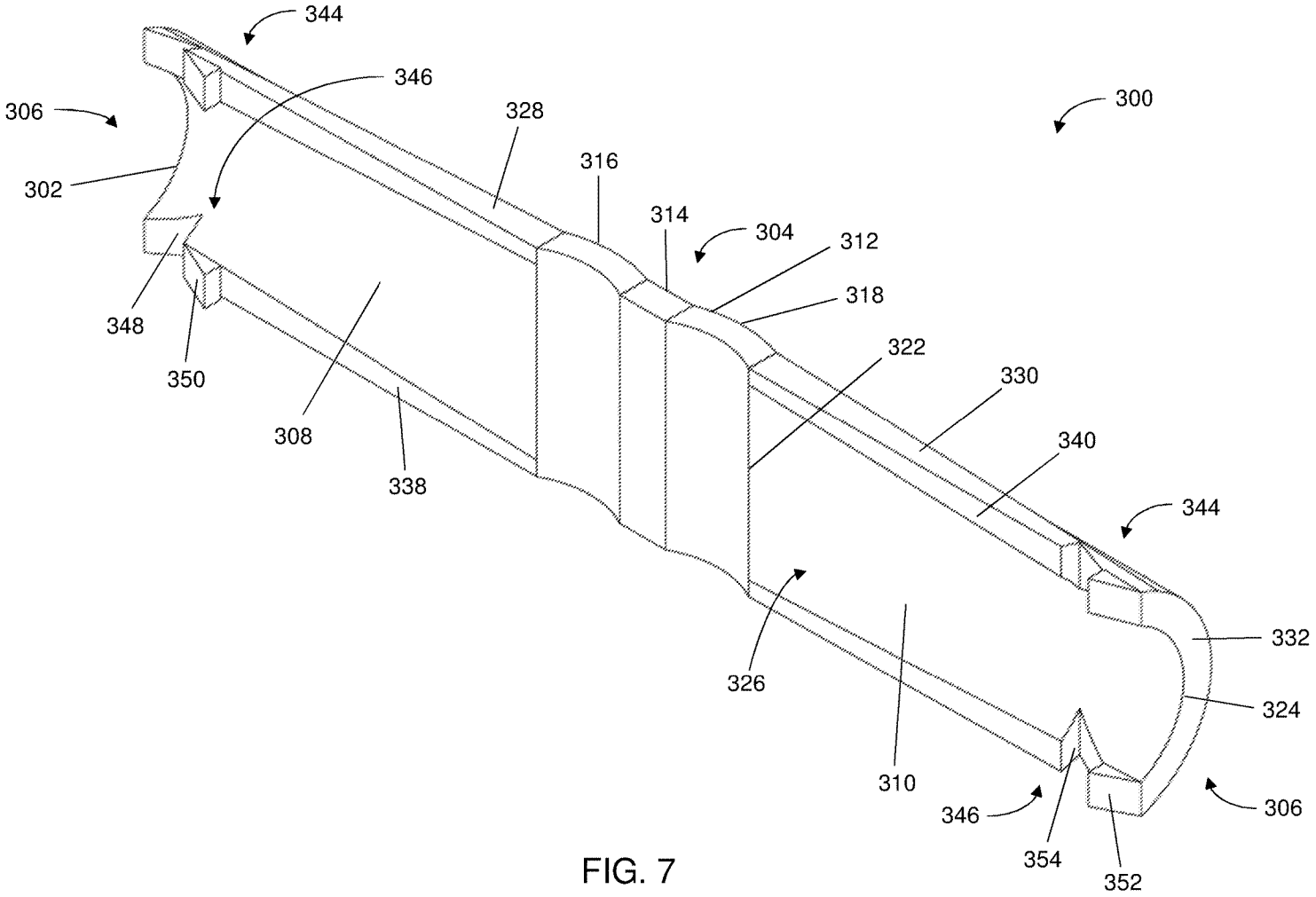
FIG. 7 is a diagrammatic, perspective view of an exemplary bra clip of the present disclosure prior to bending of the bra clip into a final form.
Figure 8:
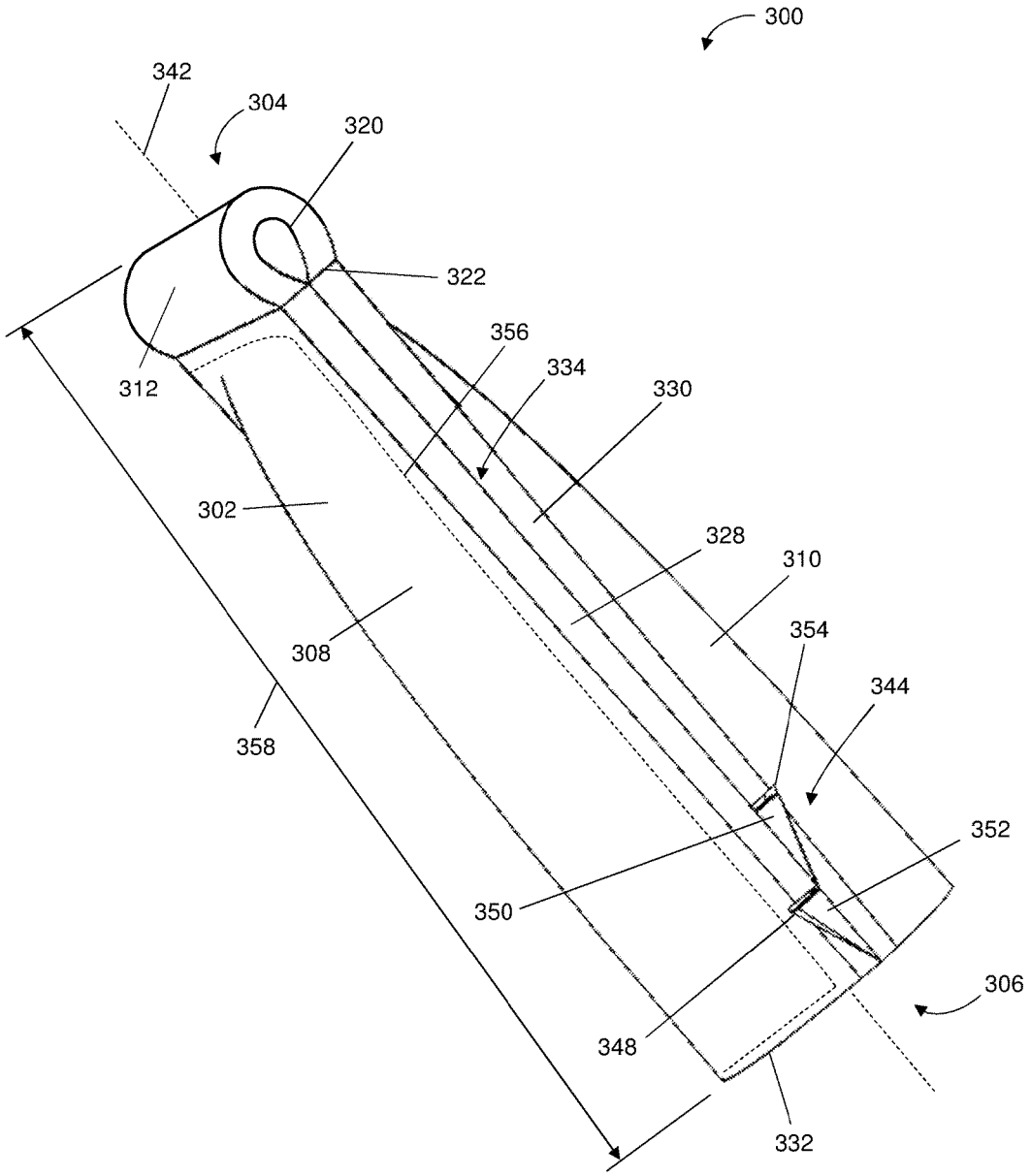
FIG. 8 is a diagrammatic, perspective view of an exemplary bra clip of FIG. 7 bent into a final form.
Figure 9:
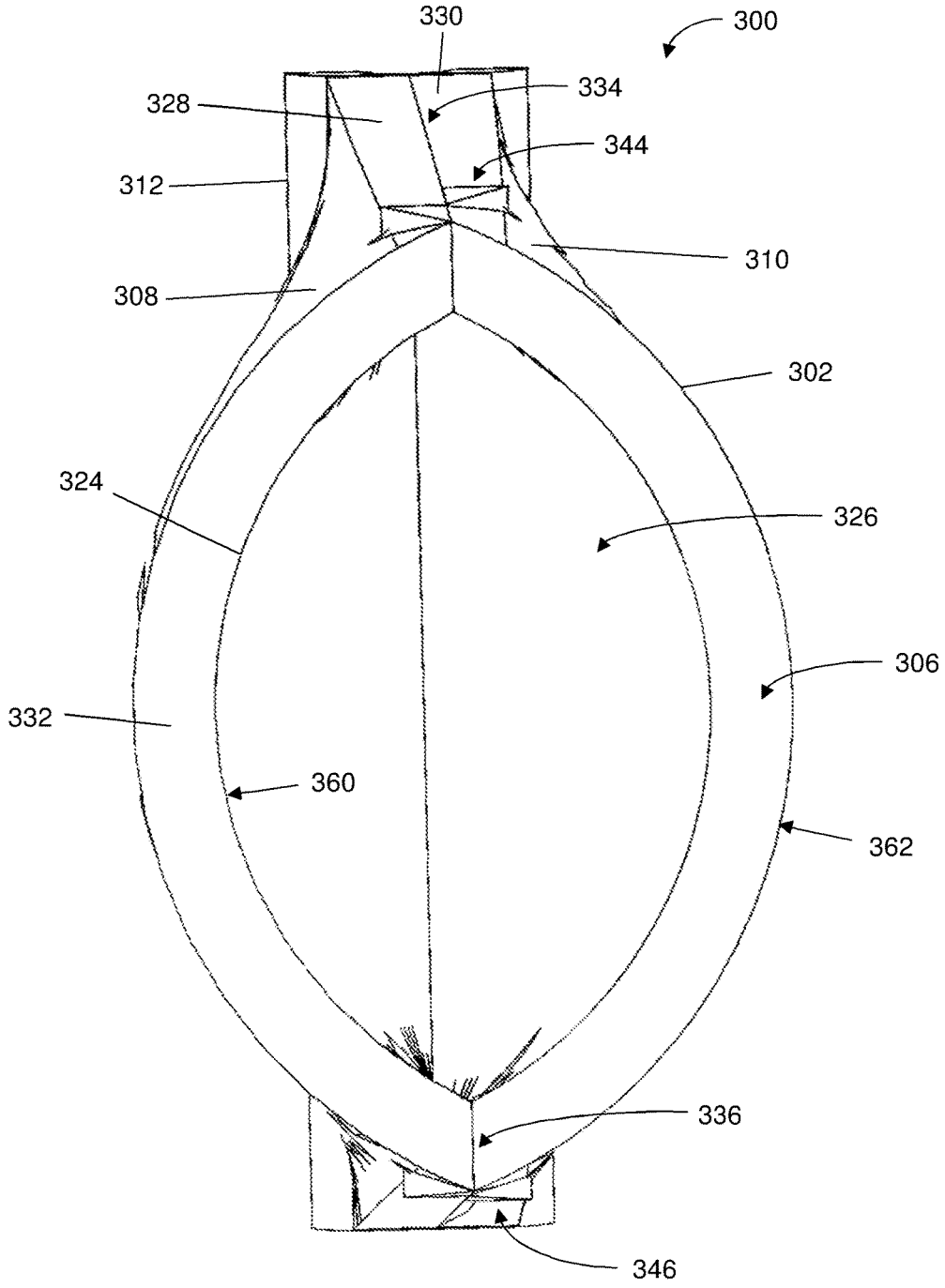
FIG. 9 is a diagrammatic, bottom view of an exemplary bra clip of FIG. 8.
Figure 10:
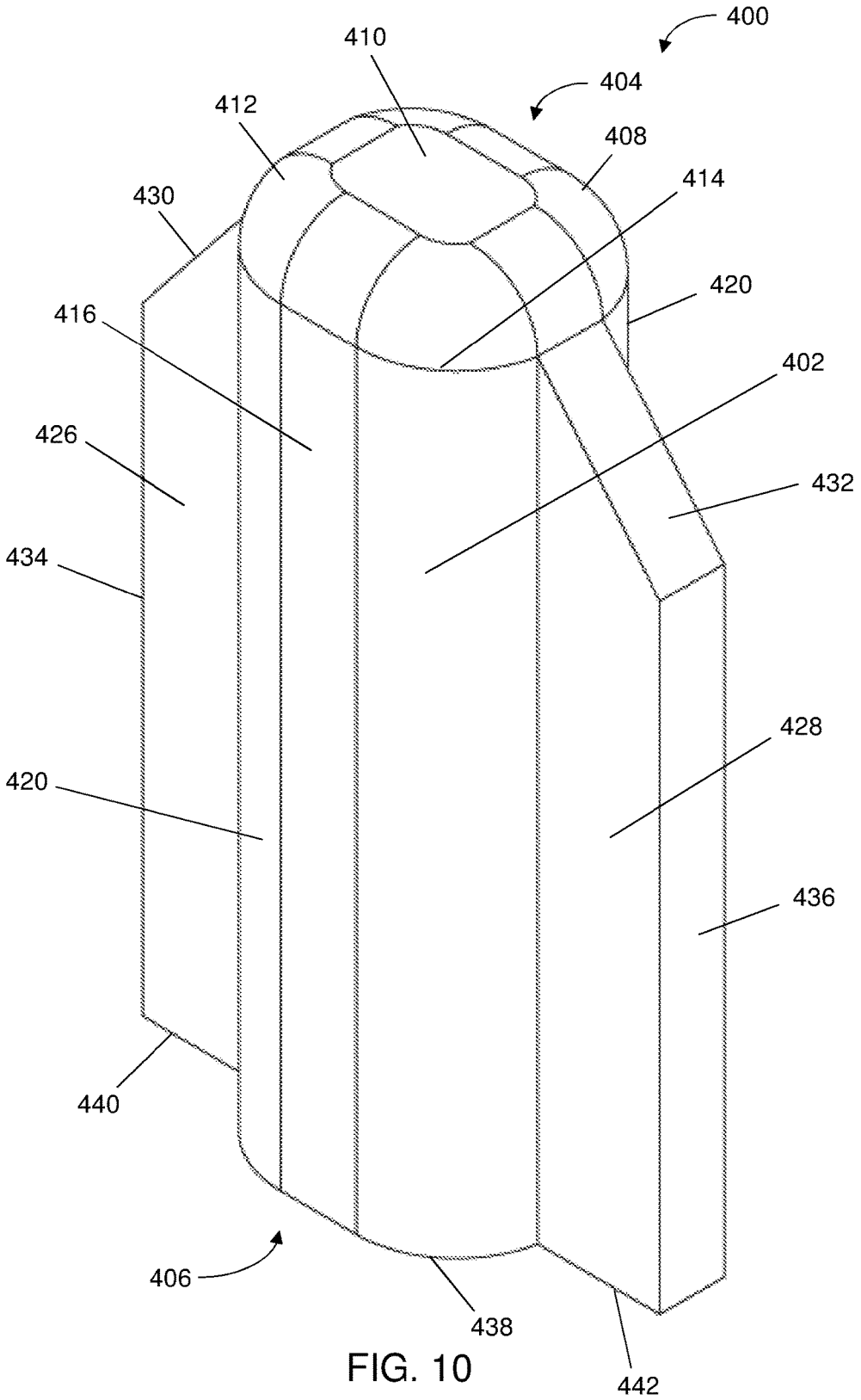
FIG. 10 is a diagrammatic, top perspective view of an exemplary bra clip of the present disclosure.
Figure 11:
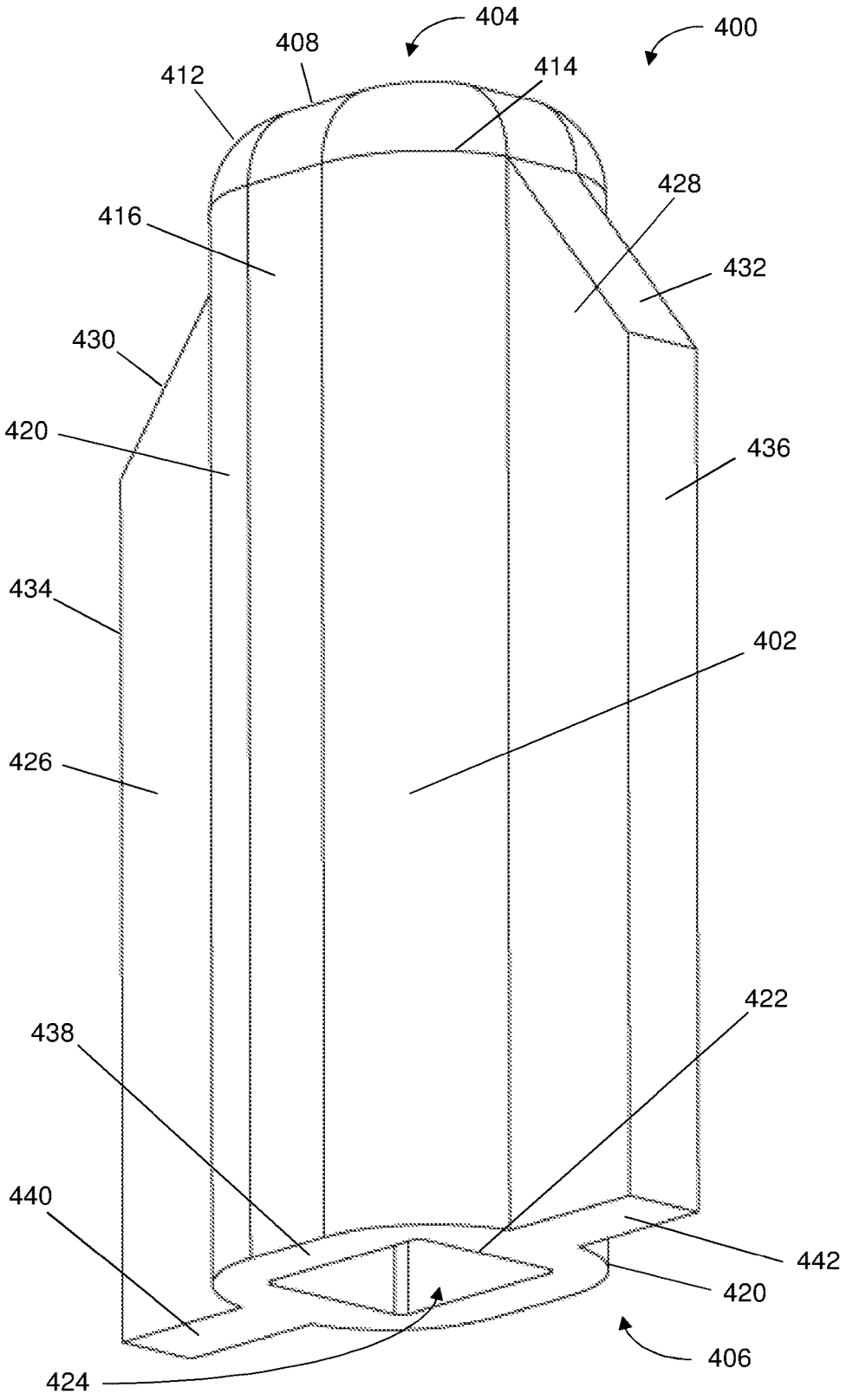
FIG. 11 is a diagrammatic, bottom perspective view of an exemplary bra clip of FIG. 10.
Figure 12:
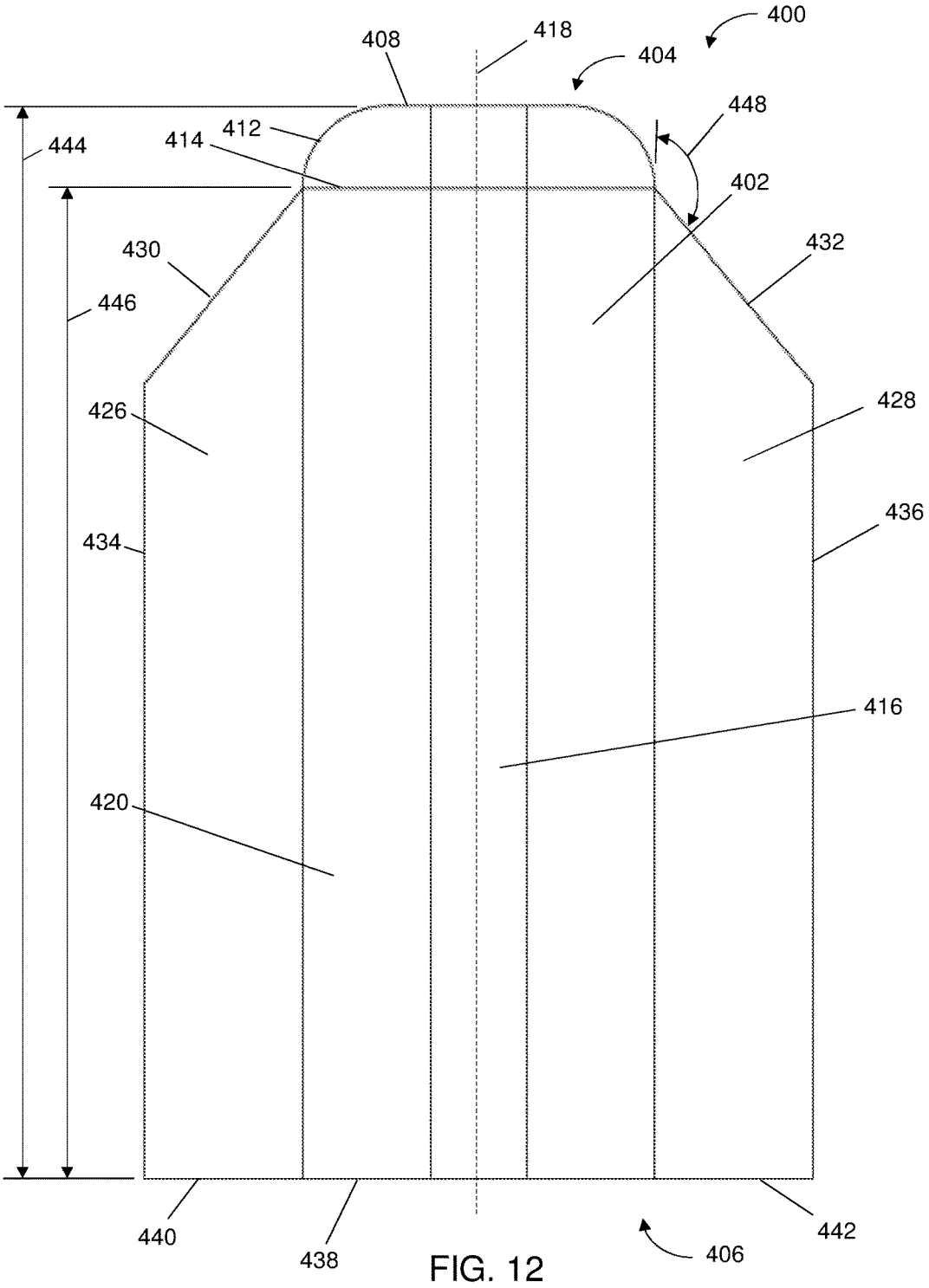
FIG. 12 is a diagrammatic, front view of an exemplary bra clip of FIG. 10.
Figure 13:
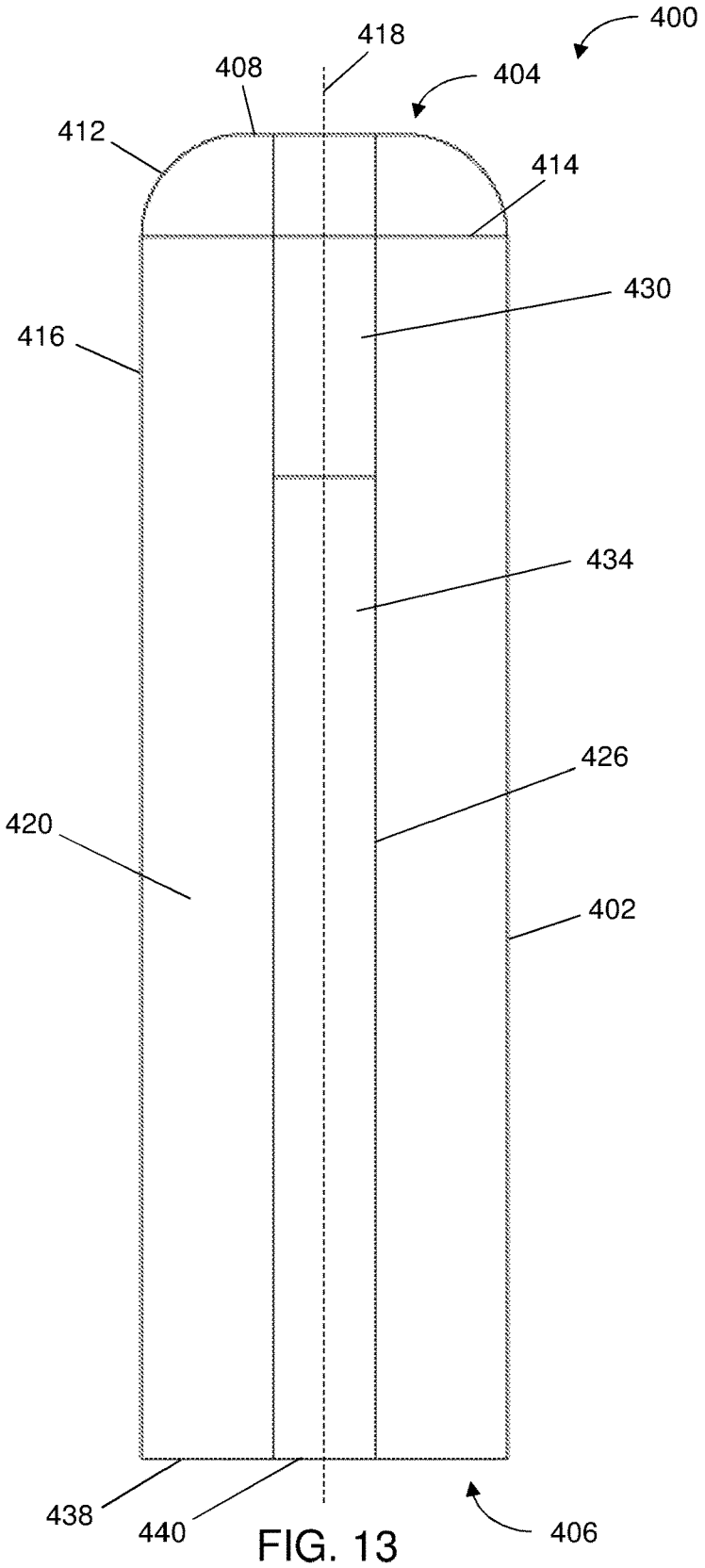
FIG. 13 is a diagrammatic, side view of an exemplary bra clip of FIG. 10.
Figure 14:
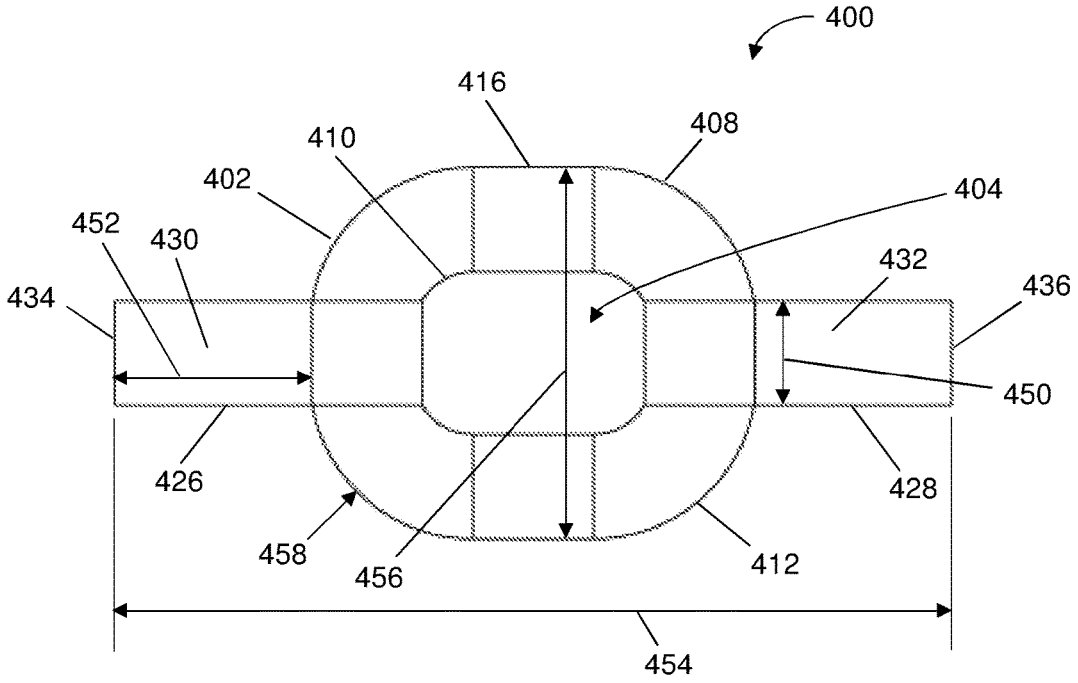
FIG. 14 is a diagrammatic, top view of an exemplary bra clip of FIG. 10.
Figure 15:
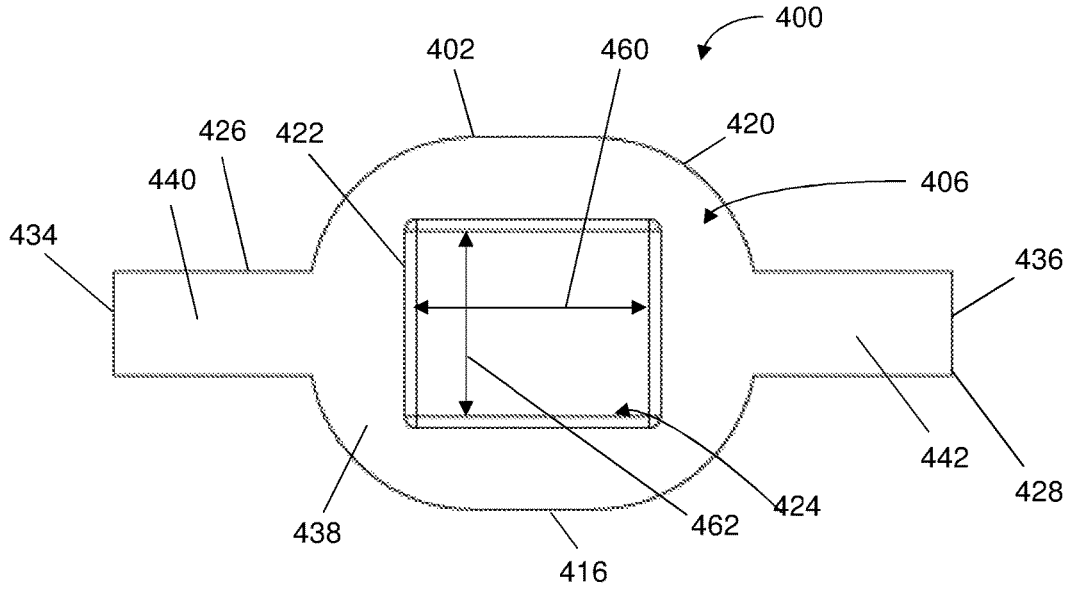
FIG. 15 is a diagrammatic, bottom view of an exemplary bra clip of FIG. 10.

FIGS. 7-9 show diagrammatic perspective and bottom views of another exemplary bra clip 300 of the present disclosure. The bra clip 300 can be positioned over the outer surface of a bra to prevent discomfort caused by a protruding underwire. FIG. 7 shows the bra clip 300 prior to bending of the bra clip 300 into a final form, while FIG. 8 shows the bra clip 300 in its final bent form. In some embodiments, the bra clip 300 initially can be fabricated by injection molding into the configuration shown in FIG. 7, and a central portion of the bra clip 300 can subsequently be heated to the point of elasticity of the material, allowing the bra clip 300 to be bent into the final form shown in FIG. 8. In some embodiments, the bra clip 300 can be fabricated directly into the configuration shown in FIG. 8. In some embodiments, the bra clip 300 can have a height or length 358 of approximately 0.85 inches when bent into the final form shown in FIG. 8.

The bra clip 300 can include a body 302 defining a proximal and distal end 304, 306 on opposing sides of the body 302. The body 302 includes first and second body halves 308, 310 extending substantially between the proximal and distal ends 304, 306. The bra clip 300 can include a closed end 312 at the proximal end 304 of the body 302. Prior to bending of the bra clip 300, the closed end 312 can include a central section 314 and two side sections 316, 318 extending on opposing sides of the central section 314. Once bent into the final form, the central section 314 and side sections 316, 318 can from a substantially cylindrical shape of the closed end 312. An opening 320 can extend laterally through the closed end 312. The closed end 312 can function as a hinge, allowing the first and second body halves 308, 310 to be flexed away from each other, and springs the first and second body halves 308, 310 towards each other when released.

The first and second body halves 308, 310 can extend from a connecting section 322 such that the first and second body halves 308, 310 connect with the closed end 312 at the connecting section 322. The bra clip 300 includes an opening 324 at the distal end 306 extending into an enclosure 326 formed between the first and second body halves 308, 310. In some embodiments, as shown in FIG. 9, the opening 324 can have a substantially football-shaped (e.g., prolate spheroid) configuration. In some embodiments, the opening 324 can have a substantially circular configuration.

The first and second body halves 308, 310 can each define a substantially semi-circular curvature (e.g., a convex configuration). In some embodiments, the degree of curvature can taper from the proximal end 304 to the distal end 306. For example, the degree of inner and/or outer curvature can incrementally increase from the proximal end 304 to the distal end 306. The curvature can therefore gradually decrease approaching the closed end 312, resulting in an overall reduction in cross-section of the bra clip 300. In some embodiments, at the distal end 306, the radius 360 of curvature of the bottommost edge of the inner edge can be approximately 0.17 inches, and the radius 362 of curvature of the bottommost edge of the outer edge can be approximately 0.20 inches.

In some embodiments, the side edges 328, 330 of the bra clip 300 (including the closed end 312) can be substantially flat. In some embodiments, a bottom edge 332 of the bra clip 300 can be substantially flat. In some embodiments, the edges discussed herein can be chamfered. The bra clip 300 includes first and second side openings 334, 336 extending between and separating the first and second body halves 308, 310. The side openings 334, 336 can connect with the opening 320 of the closed end 312 and extend to the distal end 306.

Separation of the first and second body halves 308, 310 by the side openings 334, 336 allows the first and second body halves 308, 310 to be flexed away from each other to accommodate the bra material to be positioned therebetween. The first and second body halves 308, 310 can each include inwardly facing surfaces 338, 340 that face each other. In some embodiments, as shown in the unflexed configuration of FIG. 8, the surfaces 338, 340 can abut against each other until the first and second body halves 308, 310 are flexed away from each other. The bra clip 300 can be substantially symmetrical along the central longitudinal axis 342 from both the side and front views.

One or both of the first and second body halves 308, 310 can include an engagement mechanism or feature 344, 346 to assist in maintaining the position of the bra clip 300 on the bra material by engaging the bra material. For example, the engagement feature 344, 346 in the first body half 308 can be in the form of a cutout 348 inwardly directed at or near the distal end 306 of the surface 338, and a tooth or protrusion 350 extending from the surface 338 adjacent (above) the cutout 348. The engagement feature 344, 346 in the second body half 310 can be in the form of a complementary tooth or protrusion 352 extending from the surface 340 at or near the distal end 306, and a complementary cutout 354 inwardly directed in the side surface 340 adjacent (above) the tooth or protrusion 352.

Although shown as having both a cutout and a protrusion, in some embodiments, the surface 338 can include only the cutout 348 and the surface 340 can include only the protrusion 352 (or vice versa). When positioned over the bra material, the protrusions 350, 352 can push the bra material into the respective cutouts 348, 354, thereby engaging the bra material and preventing undesired movement of the bra clip 300. In some embodiments, rather than cutouts and protrusions, the engagement mechanisms 344, 346 can be in the form of rough or textured surfaces that create a friction fit over the bra material.

In some embodiments, one or more outer surfaces of the bra clip 300 (e.g., the outer surface of the first body half 308, the outer surface of the second body half 310, the outer surface of the closed end 312, combinations thereof, or the like) can include a material 356 thereon to provide comfort the user when implementing the bra clip 300. For example, the material 356 can be secured or glued to the outer surfaces of the bra clip 300 that generally contact the skin of the user. The material 356 can be softer and/or smoother than the underlying material of the body 302 to provide greater comfort to the user. In some embodiments, the material 356 can be, e.g., cotton, moleskin, silk, combinations thereof, or the like.

The bra clip 300 can be attached to a bra 200 in a substantially similar manner as described with respect to the bra clip 100. Particularly, the first and second body halves 308, 310 can be flexed away from each other and to increase the side openings 334, 346. The bra clip 300 can be positioned on the bra 200 such that the first and second body halves 308, 310 are on opposite sides (e.g., inner and outer sides) of the bra 200. Upon release of the first and second body halves 308, 310, the engagement mechanisms 344, 346 can engage the bra 200 to maintain the position of the bra clip 300. In such position, the closed end 312 prevents the underwire 206 from protruding from the bra 200, and the curved first and second body halves 308, 310 enclose the underwire 206 and at least a portion of the seam 210 of the bra 200.

FIGS. 10-15 are diagrammatic perspective, front, side, top and bottom views of another exemplary bra clip 400 of the present disclosure. The bra clip 400 can be positioned within the seam 210 of the bra 200 (e.g., under the material 214) to prevent the underwire 206 from tearing through the material 214 of the bra 200, thereby eliminating the chance of a protruding underwire 206. Thus, rather than attaching the bra clip 400 to the bra 200 after the underwire 206 has ripped through the material 214 of the seam 210, the bra clip 400 can be incorporated into the structure of the bra 200 to prevent the underwire 206 from tearing through the seam 210.

The bra clip 400 includes a body 402 with proximal and distal ends 404, 406 on opposing sides of the body 402. The proximal end 404 includes a closed end 408 (e.g., a dome-shaped cap). In some embodiments, the closed end 408 can include a substantially flat top surface 410, and curved side walls 412 extending between the top surface 410 and a connecting section 414. The connecting section 414 can define the joint between the closed end 408 and the body 402. From the connecting section 414, the body 402 includes walls extending to the distal end 406.

In some embodiments, the walls of the body 402 can include planar sections 416 extending longitudinally substantially parallel to a central longitudinal axis 418, and chamfered or rounded corners 420 extending substantially parallel to the central longitudinal axis 418. In some embodiments, the planar sections 416 can be radially spaced by approximately 90 degrees from each other, with the corners 420 connecting the planar sections 416. The body 402 includes an opening 422 at the distal end 406 extending into an enclosure 424 within the body 402. The enclosure 424 can extend from the distal end 406 to the inner surface of the closed end 408. Thus, the body 402 can define a substantially tubular configuration.

The bra clip 400 can include first and second flanges 426, 428 extending from opposing planar sections 416 of the body 402. In some embodiments, the flanges 426, 428 can extend substantially perpendicularly relative to the side edges or planar sections 416 of the body 402. The flanges 426, 428 can extend substantially parallel to each other, and can be aligned along a plane passing through the central longitudinal axis 418. Although shown as substantially equal in thickness to the thickness of the walls of the body 402, in some embodiments, the flanges 426, 428 can be dimensioned thinner than the walls of the body 402 such that the flanges 426, 428 can be sewn through to attach the bra clip 400 to the material 214 surrounding the underwire 206 of the bra 200. In some embodiments, the flanges 426, 428 can be fabricated from a material different than the body 402, the material being more flexible and allowing for sewing therethrough.

Each of the flanges 426, 428 can define a top section 430, 432 defining a substantially triangular configuration, connected to a bottom section 434, 436 defining a substantially rectangular configuration. Each of the top and bottom sections 430-436 can define substantially planar side surfaces. Although shows as substantially planar, the side edges of the flanges 426, 428 can be chamfered. In some embodiments, the bottom surface 438 of the body 402 can be substantially planar or flat. In some embodiments, the bottom surface 438 of the body 402 can be aligned with the bottom surfaces 440, 442 of the flanges 426, 428.

In some embodiments, the overall height or length 444 of the bra clip 400 can be approximately 0.58 inches. In some embodiments, the height or length 446 between the bottom surfaces 440, 442 and the connecting section 414 can be approximately 0.43 inches. In some embodiments, the angle 448 between the vertical portion of the side walls 412 and the angled portion of the top section 430, 432 can be approximately 141°. In some embodiments, the width 450 of the flanges 426, 428 can be approximately 0.05 inches. In some embodiments, the length 452 of the flanges 426, 428 as measured from the outer surface of the body 402 can be approximately 0.09 inches.

In some embodiments, the overall width 454 of the bra clip 400 as measured from the sides of the flanges 426, 428 can be approximately 0.36 inches. In some embodiments, the depth 456 of the bra clip 400 as measured between opposing planar sections 416 can be approximately 0.16 inches. In some embodiments, the radius 458 of curvature of the side walls 412 can be approximately 0.07 inches. In some embodiments, the width 460 of the opening 422 can be approximately 0.10 inches, and the depth 462 of the opening 422 can be approximately 0.08 inches.

Figure 16:
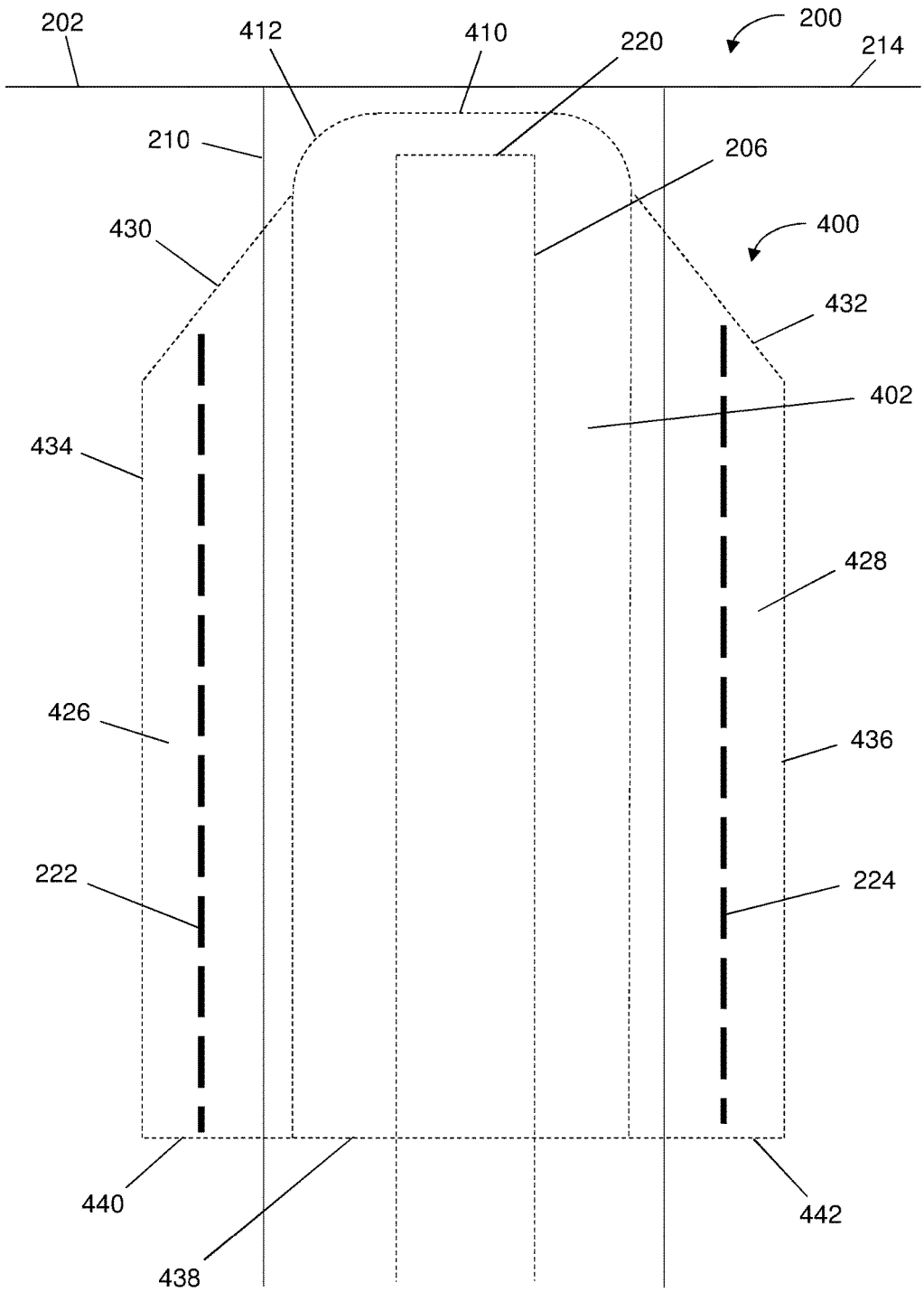
FIG. 16 is a diagrammatic, detailed front view of a bra with an exemplary bra clip of FIG. 10 attached over underwire of the bra

FIG. 16 shows a diagrammatic detailed view of the bra clip 400 incorporated into the structure of the bra 200. Particularly, the bra clip 400 can be sewn against the material 214 of the bra 200 as a preventative measure such that the endpoint 220 of the underwire 206 never tears through the top of the seam 210. For example, during assembly of the bra 200, the endpoint 220 of the underwire 206 can be passed into the enclosure 424 of the bra clip 400. The closed end 408 prevents the endpoint 220 from moving upwards and tearing through the top of the seam 210, and the walls of the bra clip 400 prevent lateral movement of the underwire 206.

During sewing of the seam 210 (or using additional sewing steps), the flanges 426, 428 of the bra clip 400 can be sewn directly against the material 214 (or within two layers of the material 214) with stitching 222, 224 such that the bra clip 400 is internally disposed and does not contact the user's skin. In some embodiments, rather than or in addition to sewing, adhesive or other attachment means can be used to secure the flanges 426, 428 to the material 214. Attachment of the bra clip 400 to the material 214 prevents undesired movement of the bra clip 400 and ensures that the endpoint 220 of the underwire 206 is maintained within the bra clip 400. The bra clip 400 therefore strengthens the overall structure of the bra 200 and prevents potential exposure of the underwire 206.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A clip for a bra, comprising:

a body defining a proximal end and a distal end, the body comprising a first body half extending between the proximal and distal ends, and the body comprising a second body half extending between the proximal and distal ends, the first and second body halves defining an enclosure therebetween;

first and second side openings extending between and separating the first body half from the second body half;

an opening at the distal end of the body, the opening extending into the enclosure between the first and second body halves; and a closed end at the proximal end of the body from which the first and second body halves extend, wherein the body is configured to be at least partially positioned over and attached to an outer surface of the bra.

2. The clip of claim 1, wherein the closed end comprises a dome-shaped top of the bra clip.

3. The clip of claim 1, wherein the first and second side openings each comprise a rounded end near the closed end of the proximal end of the body.

4. The clip of claim 1, wherein each of the first and second side openings is tapered from the proximal end to the distal end of the body, the proximal end of the first and second side openings dimensioned greater than the distal end of the first and second side openings.

5. The clip of claim 1, wherein the first and second body halves each comprise an engagement mechanism.

6. The clip of claim 5, wherein the engagement mechanism is disposed at or near the distal end of the first and second body halves.

7. The clip of claim 5, wherein the engagement mechanism of the first body half comprises a first cutout and a first protrusion on opposing sides of the first body half, and the engagement mechanism of the second body half comprises a second protrusion complementary to the first cutout and a second cutout complementary to the first protrusion.

8. The clip of claim 1, wherein the first and second body halves define an inner diameter of the enclosure, the inner diameter being substantially uniform between the proximal and distal ends of the body.

9. The clip of claim 1, wherein an inner curvature of the first and second body halves increases from the proximal end to the distal end of the body.

10. The clip of claim 1, wherein the first and second body halves together define a substantially cylindrical configuration.

11. The clip of claim 1, comprising a soft material disposed on one or more outer surfaces of the body.

12. The clip of claim 1, wherein the first and second body halves are configured to be positioned on opposing sides of a bra with the bra extending into the first and second side openings and the enclosure fitting over a seam containing an underwire of the bra.

13. A clip for a bra, comprising:

a body defining a proximal end and a distal end, the body comprising a closed end at the proximal end and comprising an opening at the distal end, the opening extending into an enclosure within the body;

a first flange extending from one side edge of the body; and a second flange extending from an opposing side edge of the body;

wherein the enclosure is configured to receive therein an endpoint of an underwire of the bra; and wherein the first and second flanges are configured to be sewn directly through a material of the first and second flanges to secure the first and second flanges to material of the bra surrounding the underwire to maintain a position of the underwire.

14. The clip of claim 13, wherein the first and second flanges extend substantially perpendicularly relative to the respective side edges of the body.

15. The clip of claim 14, wherein the first and second flanges extend substantially parallel to each other, and the body comprises flat side walls connected by chamfered corners.

16. The clip of claim 13, wherein the first and second flanges define a thickness smaller than a thickness of walls of the body.

17. A bra, comprising:

an underwire comprising first and second opposing ends; and a bra clip disposed at least on one of the first and second opposing ends of the underwire, the bra clip comprising:

a body defining a proximal end and a distal end, the body comprising a closed end at the proximal end and comprising an opening at the distal end, the opening extending into an enclosure within the body;

a first flange extending from one side edge of the body; and a second flange extending from an opposing side edge of the body;

wherein the enclosure receives therein the first or second end of the underwire of the bra; and wherein the first and second flanges are sewn directly through a material of the first and second flanges to secure the first and second flanges to material of the bra surrounding the underwire to maintain a position of the underwire.

18. The clip of claim 13, wherein the first and second flanges are aligned along a plane passing through a central longitudinal axis of the body.

19. The clip of claim 13, wherein the first and second flanges extend from the body between a connecting section and the distal end of the body, the connecting section offset from the proximal end of the body such that a length of the clip is dimensioned greater than a length of the first and second flanges.

* * * * *